US008479942B2

(12) United States Patent
Antal, Sr.

(10) Patent No.: US 8,479,942 B2
(45) Date of Patent: Jul. 9, 2013

(54) REMOVABLE LID FOR A CONTAINER

(75) Inventor: Keith E. Antal, Sr., Valatie, NY (US)

(73) Assignee: Sonoco Development, Inc., Hartsville, SC (US)

( * ) Notice: Subject to any disclaimer, the term of this patent is extended or adjusted under 35 U.S.C. 154(b) by 262 days.

(21) Appl. No.: 12/850,065

(22) Filed: Aug. 4, 2010

(65) Prior Publication Data

US 2012/0031903 A1 Feb. 9, 2012

(51) Int. Cl.
*B65D 51/18* (2006.01)
*B65D 41/18* (2006.01)

(52) U.S. Cl.
USPC ..... 220/254.3; 220/788

(58) Field of Classification Search
USPC ..... 220/254.3, 784, 788, 792
See application file for complete search history.

(56) References Cited

U.S. PATENT DOCUMENTS

| | | | | | |
|---|---|---|---|---|---|
| 2,522,952 | A | | 9/1950 | Krohn | |
| 3,095,995 | A | | 7/1963 | Foster | |
| 3,417,897 | A | * | 12/1968 | Johnson | 220/254.3 |
| 3,421,654 | A | | 1/1969 | Hexel | |
| 3,773,232 | A | | 11/1973 | Hidding | |
| 3,872,996 | A | | 3/1975 | Dogliotti | |
| 3,893,566 | A | * | 7/1975 | Ross | 220/258.2 |
| 3,904,074 | A | * | 9/1975 | Hoffman et al. | 220/258.3 |
| 3,913,774 | A | | 10/1975 | Vajtay | |
| 3,995,766 | A | | 12/1976 | Fralick | |
| 4,026,459 | A | | 5/1977 | Blanchard | |
| 4,040,536 | A | | 8/1977 | Schwarz | |
| 4,144,985 | A | | 3/1979 | Kinslow | |
| 4,163,496 | A | | 8/1979 | Dogliotti | |
| 4,194,645 | A | * | 3/1980 | Zabner et al. | 220/781 |
| D255,995 | S | | 7/1980 | Kinslow | |
| 4,303,176 | A | | 12/1981 | Swartzbaugh | |
| 4,421,244 | A | | 12/1983 | Van Melle | |
| 4,463,869 | A | | 8/1984 | Lewis | |
| 4,491,252 | A | | 1/1985 | Schmidt et al. | |
| 4,512,493 | A | * | 4/1985 | Von Holdt | 220/782 |
| 4,538,731 | A | | 9/1985 | Cillario | |
| 4,923,085 | A | | 5/1990 | Lillelund et al. | |
| 5,139,164 | A | | 8/1992 | Stewart | |
| 5,339,993 | A | | 8/1994 | Groya et al. | |
| 5,490,609 | A | | 2/1996 | Lane et al. | |
| 5,678,720 | A | | 10/1997 | Van Melle | |
| 5,730,352 | A | | 3/1998 | Deekes | |
| 5,769,267 | A | | 6/1998 | Duynslager et al. | |

(Continued)

*Primary Examiner* — Mickey Yu
*Assistant Examiner* — Niki Eloshway
(74) *Attorney, Agent, or Firm* — Flaster/Greenberg, P.C.

(57) ABSTRACT

A lid is defined for removably attaching to a hollow container body. The container is contemplated to be of the type having an opening thereon defined by a projecting rim. A bead may be formed on the rim projecting transverse to the direction of the rim projection. The lid includes a body for covering at least a portion of the container opening and a skirt depending from the body portion. The skirt is formed to engage the rim to removably secure the lid on the opening. One or more set of ridges is formed on the inner surface of the skirt at defined locations. The ridges are positioned substantially transverse to the bead and frictionally engaging the bead for securing the lid on the container opening. One or more retention tabs may also be provided on the inside surface of the skirt for engaging the underside of the bead on the rim. The bead of the container rim may also include a corresponding number of set of rim ridges, wherein the skirt ridge sets are positioned at locations for engaging with the sets of rim ridges.

33 Claims, 4 Drawing Sheets

U.S. PATENT DOCUMENTS

| | | | | |
|---|---|---|---|---|
| 5,839,601 | A | 11/1998 | Van Melle | |
| 5,911,331 | A | 6/1999 | Boller | |
| 5,947,323 | A | 9/1999 | Freek et al. | |
| 6,003,713 | A | 12/1999 | Derving | |
| 6,056,144 | A | 5/2000 | Strange et al. | |
| 6,112,889 | A | 9/2000 | Wicker | |
| 6,152,318 | A | 11/2000 | Walker | |
| 6,279,788 | B1 | 8/2001 | Lillelund et al. | |
| 6,478,183 | B1 | 11/2002 | Bacon et al. | |
| 6,484,929 | B2 | 11/2002 | Sumpmann et al. | |
| 6,523,713 | B1 | 2/2003 | Helms | |
| 6,659,274 | B2 | 12/2003 | Enners | |
| 7,090,088 | B2 * | 8/2006 | von Holdt, Jr. | 220/276 |
| D536,613 | S | 2/2007 | Vogel et al. | |
| 7,258,255 | B2 | 8/2007 | Vogel et al. | |
| 7,530,478 | B2 | 5/2009 | Blomdahl et al. | |
| 7,556,173 | B2 | 7/2009 | Solowiejko | |
| 2002/0070218 | A1 | 6/2002 | Mozes | |
| 2002/0162846 | A1 * | 11/2002 | Mercier | 220/780 |
| 2004/0206757 | A1 | 10/2004 | Hall et al. | |
| 2004/0256348 | A1 | 12/2004 | Stevens et al. | |
| 2005/0023304 | A1 | 2/2005 | Vogel et al. | |
| 2006/0124643 | A1 * | 6/2006 | Markert et al. | 220/254.3 |
| 2008/0110942 | A1 * | 5/2008 | Blomdahl et al. | 222/556 |
| 2008/0264947 | A1 | 10/2008 | Morenstein et al. | |
| 2009/0101674 | A1 | 4/2009 | Newberry et al. | |

* cited by examiner

REMOVABLE LID FOR A CONTAINER

FIELD OF THE INVENTION

The present invention relates to a lid, overcap or similar closure to be applied to a container, with the lid being removably secured to the container opening.

BACKGROUND OF THE INVENTION

A number of forms of lids and closures are known for covering the open end of a container and for selectively controlling the discharge of material from the container.

U.S. Pat. No. 5,947,323 to Freek et al shows a lid for a beverage cup. The lid includes a tear-back portion having a lifting tab formed on a peripheral skirt. Projecting inwardly from the skirt on opposite sides of the lifting tab are two elongated beads. Within the tear-back portion are provided two relatively shorter beads. The elongated beads retain the lid on the rim of the cup. The shorter beads assist in re-securing the tear-back portion on the cup rim, once initially opened.

U.S. 2004/0206757 to Hall et al shows a universal lid to be attached to a plurality of different size food packages. The lid includes a peripheral channel for retaining an open rim of a box. A plurality of vertical protrusions or ribs is formed in a channel to engage the wall of the box and to secure the lid on the rim. A plurality of spaced panels or walls is formed on the bottom surface for conforming the lid to the length of the box. Ribs are also provided within the channels formed by the panels.

U.S. Pat. No. 6,056,144 to Strange et al shows a lid for a beverage cup having a peripheral skirt formed for securing the lid to the rim of the cup. A plurality of relatively smaller "protuberances" is provided around the skirt. Within the plurality of the smaller protuberances are provided three oblong protuberances.

U.S. Pat. No. 3,872,996 to Dogliotti shows a container for granular materials having a separable, hollow plug that forms the cover for the container. The plug includes a pivotable flap for providing access to the interior of the container, through the plug. Outer peripheral surfaces on the plug include a plurality of parallel ribs. A corresponding number of ribs are also provided on the inside surface of the container. Upon insertion of the plug into the open end of the container, the two sets of ribs interfere with one another to retain the plug within the container.

U.S. Pat. No. 7,258,255 to Vogel et al shows a container closure or lid having a peripheral skirt portion for securing the lid to the rim of a container. In one embodiment, interfering projections are provided on the inside surface of the skirt and the outside surface of the container rim. The projections overlap one another when the lid is positioned on the rim to secure the lid to the container.

SUMMARY OF THE INVENTION

A lid is defined for removably attaching to a hollow container body. The container is contemplated to be of the type having an opening thereon defined by a projecting rim. A bead may be formed on the rim projecting transverse to the direction of the rim projection. The lid includes a body for covering at least a portion of the container opening and a skirt depending from the body portion. The skirt is formed to engage the rim to removably secure the lid on the opening. One or more set of ridges is formed on the inner surface of the skirt at defined locations. The ridges are positioned substantially transverse to the bead and frictionally engaging the bead for securing the lid on the container opening. One or more retention tabs may also be provided on the inside surface of the skirt for engaging the underside of the bead on the rim. The bead of the container rim may also include a corresponding number of set of rim ridges, wherein the skirt ridge sets are positioned at locations for engaging with the sets of rim ridges.

Other features of the present invention will become apparent from the detailed description to follow, taken in conjunction with the accompanying drawings.

BRIEF DESCRIPTION OF THE DRAWINGS

For the purpose of illustrating the invention, the drawings show forms that are presently preferred. It should be understood that the invention is not limited to the precise arrangements and instrumentalities shown in the drawings.

DETAILED DESCRIPTION

Figure 1:
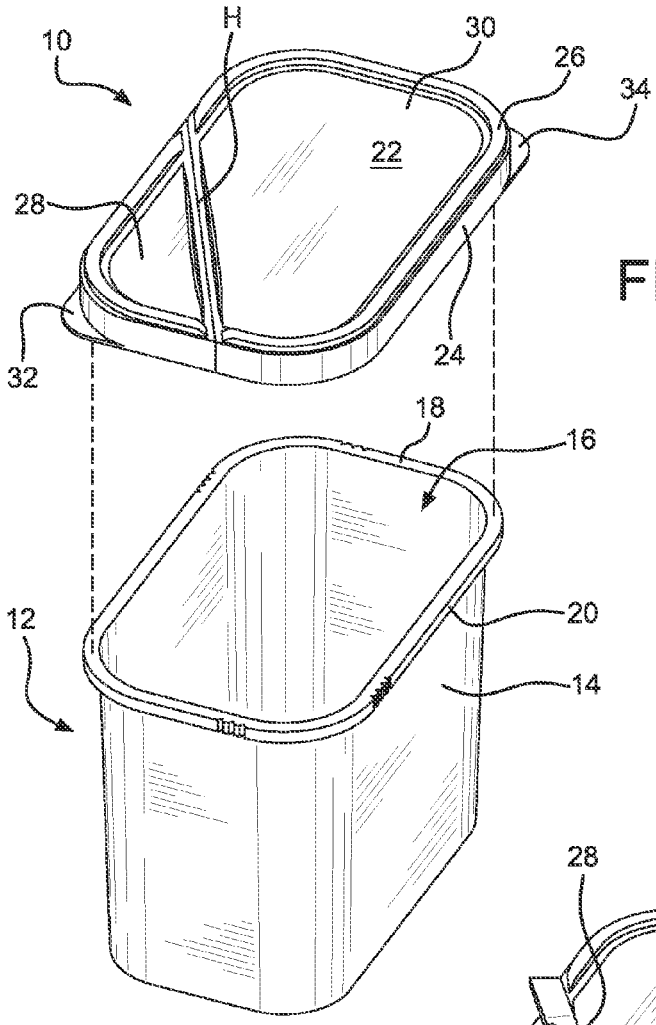
FIG. 1 shows an exploded perspective view of a lid and container combination as contemplated by the present idea.
Figure 2:
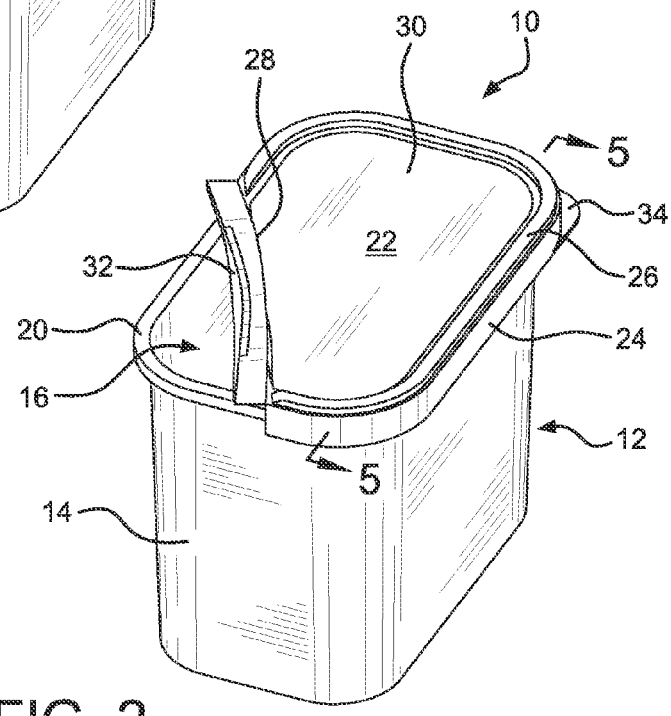
FIG. 2 shows a perspective view of the lid and container of FIG. 1 with the lid mounted on the container opening and a spout portion of the lid in the open position.

In the figures, where like numerals identify like elements, there is shown an embodiment of a lid and container. In FIGS. 1 and 2, the lid is generally identified by the numeral 10 and is positioned on the open top end of the container, as generally identified by the numeral 12. The container 12 is defined by a plurality of wall portions 14 and defines an interior volume 16 for storing a desired contents (not shown). At the top end of the container is defined an opening 18 into the interior volume 16. The opening is defined by a rim 20.

The lid 10 includes a cover panel 22 foamed to cover all or a portion of the container opening 18. A skirt 24 is provided on the periphery of the cover panel 22. The skirt 24 is dimensioned to fit over the rim 20 of the container 12 and to removably secure the lid 10 on the container 12. As shown, a channel or ridge 26 is formed adjacent the skirt 24 on the upper surface of the cover panel 22. The projection of the channel serves as a stand off rim for the lid and container stacking and may also serve to stiffen the lid. In an alternative structure, the channel may be dimensioned for receipt of the container rim and may provide an additional engagement on the rim along an inside surface of the wall portions of the container. The cover panel 22 of the lid 10 includes a spout flap 30 at one corner thereof. As shown in FIG. 2, the spout flap 28 is pivotably attached to a body portion 30 of the cover 22 and my be selectively opened to permit pouring discharge or other access to the contents of the container 12.

Figure 3:
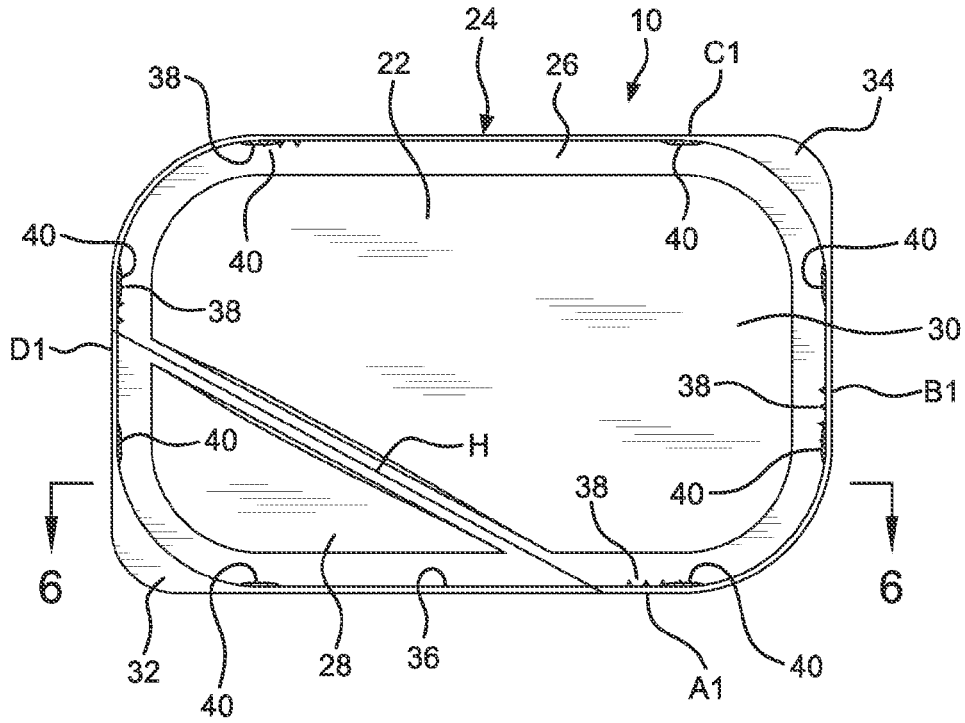
FIG. 3 shows a bottom plan view of the lid of FIGS. 1 and 2.

In FIG. 3, there is shown the underside of the lid 10. The skirt 24 forms the outer perimeter of the lid 10, with two lifting tabs 32, 34 provided on opposing corners. The first tab 32 extends outwardly from the corner of the lid adjacent the spout flap 28. The tab 32 is used to open the flap 28 (as shown in FIG. 2). The second tab 34 is associated with the body 30 of the cover panel 22. An upward force applied to tab 34 will cause a separation of the body portion 30 from the rim 20 of the container 12 and permit removal of the lid 10 from the opening 18.

Figure 4:
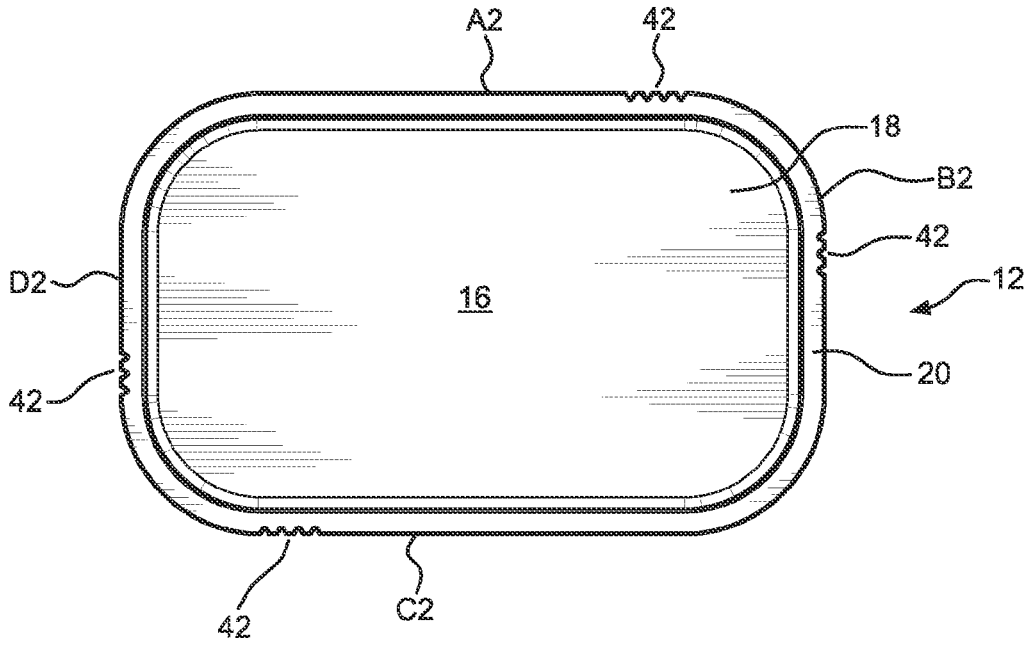
FIG. 4 shows a top plan view of the container of FIGS. 1 and 2.

As shown in FIG. 3, the various sides of the lid 10 are labeled A1, B1, C1 and D1. In addition, the connection between the flap 28 and the body 30 of the cover panel 22 is labeled H. This connection is preferably a living hinge that is integrally formed with the remaining portions of the lid 10. In FIG. 4, there is shown the open end 18 of the container 12, looking into the interior volume 16. The contour of the rim 20 matches that of the lid 10, with the skirt 24 extending around the outside of the rim 20. The various sides of the rim 20 are labeled A2, B2, C2 and D2. These rim sides shown in FIG. 4 match the position of the lid sides shown in FIG. 3. Thus, lid side A1 corresponds to rim side A2, etc. However, a rotation of the lid 10 by 180 degrees is permissible in attaching the present embodiment of the lid to the container.

In FIG. 3 there is shown on the bottom surface of the lid 10 and a number of structures on the inside surface 36 of the skirt 24. These structures are provided for securing and engaging the lid 10 to the rim 20 of the container 12. Referring to side Al for illustrative purposes and to the cross section view shown in FIG. 6, the inside surface 36 of the skirt 24 includes two types of projections 38, 40. A set of closely spaced ridges 38 for the first projection type. The ridges 38 are aligned transverse to the cover panel and, when the lid is positioned on the container opening 18, are substantially perpendicular to the rim 20. The ridges 38 are positioned on the skirt at a corresponding location of a set of closely spaced grooves 42 in the container rim (see FIG. 4).

Figure 5:
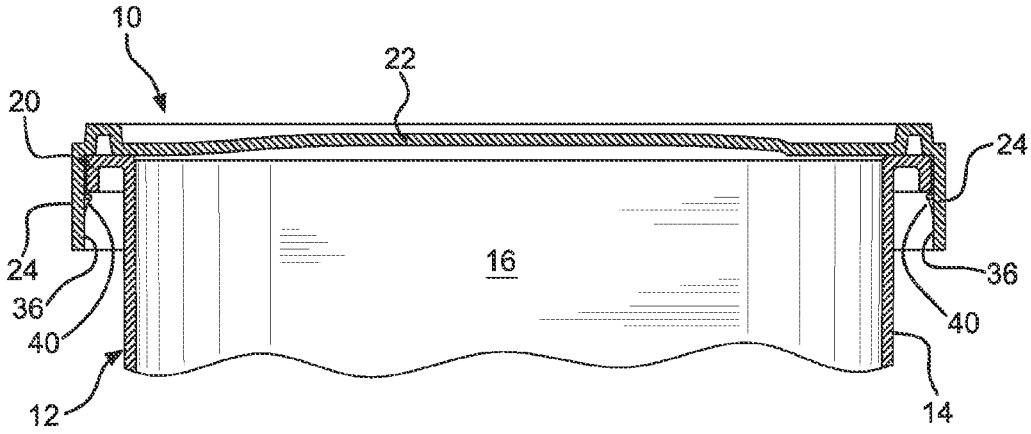
FIG. 5 shows a cross sectional view of the lid and container as taken along line 5-5 in FIG. 2.

The second type of projection formed on the inside surface 36 of the skirt 24 is a projection tab 40. The projection tabs 40 formed on the inside surface 36 of the skirt 24 engage under the rim 20 of the container 12. This relationship is illustrated in FIG. 5. The projection tabs 40 serve primarily to secure the lid 10 to the container rim 20 and resist removal of the lid 10 without a sufficient removal force.

Figure 6:
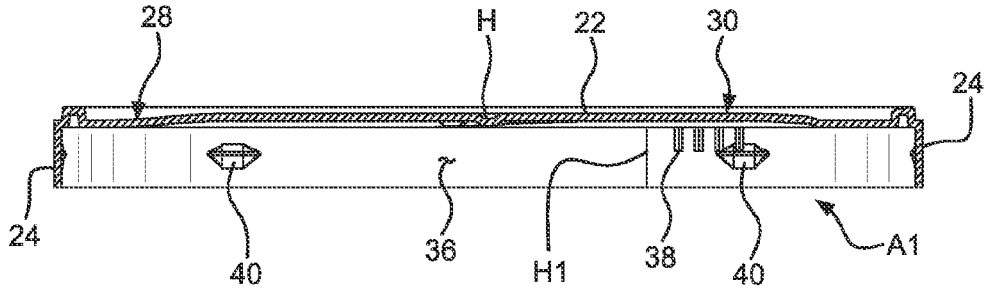
FIG. 6 shows a cross sectional view of the lid as taken along line 6-6 in FIG. 4.

As shown on side Al in FIG. 6, there are two projection tabs 40, one positioned adjacent opposing ends of the skirt side wall. One of the tabs 40 overlaps with the set of ridges 38, although the two are positioned at different distances from the cover panel 22. In addition, the combined ridges 38 and projection tab 40 structures are formed on the side of the lid 10 corresponding to the body 30 of the cover panel 22, with one projection tab 40 formed on the side of the hinge H corresponding to the spout flap 28. In the cross section of FIG. 6, the break H1 in the skirt 24 is shown. The break H1 permits the spout flap 28 to pivot to the open position shown in FIG. 2.

An arrangement of ridge sets 38 and projection tabs 40 is formed each side B1, C1 and D1 of the lid 10, as shown in FIG. 3. The ridge sets 38 that are combined with the projection tabs 40 are provided on both sides of opposing corners. The projection tabs 40 are provided without adjacent ridge sets on the corner of the lid 10 forming the spout flap 28 and on the corner opposite the flap 28.

Figure 7:
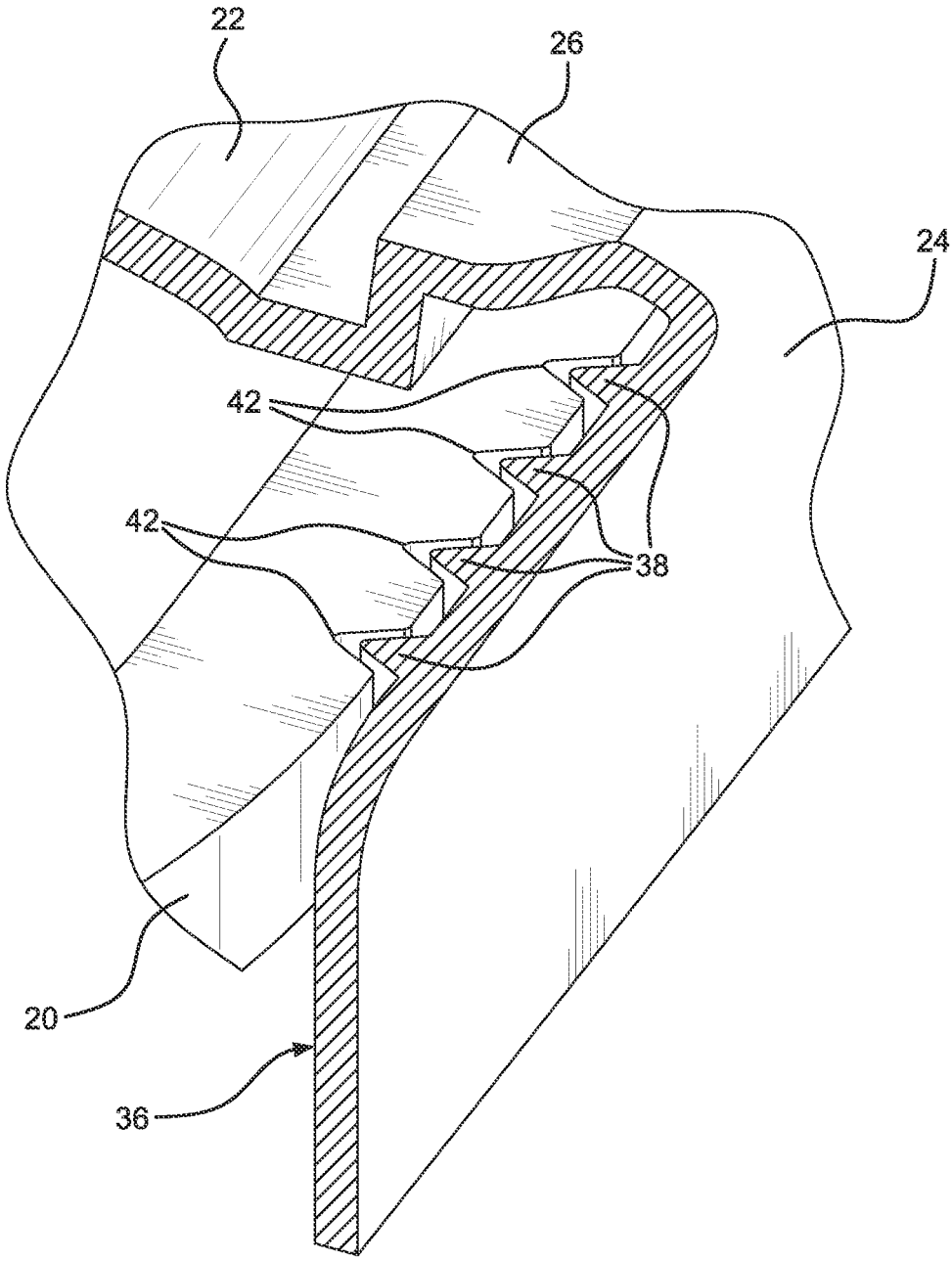
FIG. 7 shows a partial perspective view of the engagement between the lid and container.

The interrelationship of the ridges and grooves is illustrated in FIG. 7. The ridges 38 project inwardly from the inside surface 36 of the skirt 24. When the lid 10 is positioned over the opening 18 of the container 12, the ridges 38 align with and are preferably received within the grooves 42 on the rim 20. The ridge sets 38 frictionally engaging the container rim 20. The groove sets 42 add to the engagement of the lid skirt 24 to the rim 24.

It is typical in the formation of a lid or overcap for a container to have a certain amount of dimensional variation that creates play in the attachment of the lid to the container rim. Further, the container may be formed from paper or a composite material, with a rolled rim. These materials are relatively pliable and the lid can move when placed on the rim. The engagement of the lid on the rim may be compromised during handling and use. For example, the opening of a flap portion may sometimes result in the entire lid separating from the rim, rather than just the hinged flap.

In the present lid 10 and container 12 combination, the engagement of the skirt 24 and the rim 20 is enhanced by the addition of the ridge sets 38 and grooves 42. The projection tabs 40 are provided to initially retain the lid 10 on the rim 20 of the container 12. The tabs 40 are positioned on the inside surface 36 of the skirt 24 at a position where they will move under the bottom edge of the rim 20, as shown in FIG. 5. The ridges 38 and grooves 42 are provided at opposing corners of the body 30 of the lid 10 to frictionally enhance the engagement. In the preferred structure, the ridges 38 are not provided on the flap portion 28 of the lid 10. When the flap 28 is opened, by applying an upward force on the lifting tab 32, the combination of the ridge sets 38 and tabs 40 on the body portion 30 remain engaged. The extra engagement securing the body 30 to the rim 20 permits the tabs 40 on the flap 28 to release from the rim 20 and open the flap 28, as in FIG. 2. The relationship between the groove sets 42 and the ridge sets 38 further enhances the engagement of the body portion of the lid 10 on the rim 20.

The lid is contemplated to be integrally formed from a thermoplastic material. However, various assemblies of the structures and other materials are possible. The container may also be molded using a thermoplastic, although other materials are contemplated, including paperboard and composites including paper materials. Further, the rim portion may be molded and separately attached to the walls of the container. The grooves in the rim of the container may be formed as part of the molding process or may be added subsequently. If the rim is made of a paperboard or composited material, a cut or crease may be added to the rim.

It is contemplated that the structures on the rim may include ridges or similar projections that engage with the ridges on the skirt. The skirt may also include formed grooves or the like for engaging the corresponding structure of the container rim. Preferably, the ridges and grooves, or similar engagement structures, are formed in direction substantially perpendicular to the direction of the formed rim. However, an angled relationship may also provide the desired engagement between the rim and lid.

In the embodiment shown, the outline of the lid and container opening is generally rectangular. Thus, two sides A and C of the lid and rim are longer than the sides B and D. Other forms are possible. In the structure shown, the lid is limited to two positions on the rim. For example, lid side A1 may be positioned to engage rim side A2 or C2.

In the preferred structure, the ridges 38 and grooves 42 are positioned in opposing corners and align in either position of the lid 10. This places the ridge and groove combinations adjacent the two ends of the hinge H in the cover panel 22. The additional engagement of the ridges and grooves is positioned to hold the body portion 30 on the rim 20 while the flap 28 is separated from the rim 20. In the other corners of the rim 20, there are no grooves and the flap 28 does not included ridges. The flap does not encounter the additional engagement provided by the groove and ridge combination.

The present invention has been described and illustrated with respect to a number of exemplary embodiments thereof It should be understood by those skilled in the art from the foregoing that various other changes, omissions and additions may be made therein, without departing from the spirit and scope of the present invention, with the scope of the present invention being described by the foregoing claims.

What is claimed is:

1. A removable lid and container combination, comprising:

a container having a body forming a defined storage chamber and an opening for providing access to the chamber, the opening having an upstanding, peripheral container rim, the container rim having a portion projecting outwardly, transverse to the opening, the outwardly projecting portion having a plurality of sets of closely spaced rim ridges, and a lid comprising a body portion dimensioned to cover at least a portion of the opening, a skirt projecting from the body portion and formed to surround and engage at least a portion of the container rim and for supporting the body portion in a covering relationship with the opening, and a plurality of sets of closely spaced ridges, the sets of ridges formed at multiple defined locations that are spaced from one another on an interior surface of the skirt, each of the sets of ridges directed transverse to the skirt and formed for engaging the projecting container rim, each of the sets of ridges positioned on the skirt for engaging a corresponding rim ridge set on the outwardly projecting portion of the container rim when the body portion is positioned on the container rim in a covering relationship with the opening, the sets of ridges and the sets of rim ridges formed to frictionally engage one another such that the lid at the location of the corresponding ridge sets is secured to the container rim to a greater extent than the remaining portions of the interior of the skirt for retaining the lid on the container rim.

2. The removable lid and container combination of claim 1 wherein the body portion comprises a main section and a pouring section, the pouring section hinged to the main section, each section having a corresponding skirt section.

3. The removable lid and container combination of claim 2 wherein the plurality of the sets of ridges is formed on the main skirt section and adjacent the hinged attachment of the main section to the pouring section.

4. The removable lid and combination of claim 1 wherein the lid further comprises at least one retention tab projecting from the inside surface of the skirt for engaging the underside of the outwardly projecting portion of the container rim.

5. The removable lid and container combination of claim 4 wherein the retention tab is spaced from the position of the set of ridges on the skirt.

6. The removable lid and container combination of claim 5 wherein the body portion comprises a main section and a pouring section, the pouring section hinged to the main section, each section having a corresponding skirt section.

7. The removable lid and container combination of claim 6 wherein the plurality of the sets of ridges is formed on the main skirt section and adjacent the hinged attachment of the pouring section to the main section.

8. A removable lid for a container, the container of the type having a defined storage chamber and an opening for providing access to the chamber, the opening having an upstanding, peripheral container rim, the lid comprising:

a body portion dimensioned to cover at least a portion of the container opening, the body portion comprising a main section and a pouring section, the pouring section hinged to the main section, a skirt projecting from the body portion and formed to engage at least a portion of the container rim for supporting the body portion in a covering relationship with container opening, the main section and the pouring section both having a corresponding skirt section, a set of closely spaced ridges formed at a defined location on an interior surface of the skirt, the set of ridges aligned transverse to the side edge of the container rim, the ridges engaging the container rim when the body portion is positioned thereon in a covering relationship with the opening, the set of ridges formed to frictionally engage the container rim to a greater extent than the remaining portions of the interior of the skirt, the set of ridges formed on the main skirt section positioned adjacent the hinged attachment of the pouring section, and a second closely spaced set of ridges formed on the interior of the skirt at a defined location and spaced from the location of the first mentioned set of ridges.

9. The removable lid of claim 8 wherein the second set of ridges is formed on the main skirt section adjacent the hinged attachment of the pouring section.

10. A removable lid and container, comprising:

a container having a defined storage chamber and an opening for providing access to the chamber, the opening having an upstanding, peripheral container rim, the container rim having an outwardly directed bead portion, a lid comprising:

a body portion dimensioned to cover at least a portion of the container opening, a skirt projecting from the body portion and formed to engage at least a portion of the container rim for supporting the body portion in a covering relationship with container opening, the main section and the pouring section both having a corresponding skirt section, a set of closely spaced ridges formed at a defined location on an interior surface of the skirt, the set of ridges aligned transverse to the side edge of the container rim, the ridges engaging the container rim when the body portion is positioned thereon in a covering relationship with the opening, the set of ridges formed to frictionally engage the container rim to a greater extent than the remaining portions of the interior of the skirt, and at least one retention tab projecting from the inside surface of the skirt for engaging the underside of the bead portion on the container rim, the bead portion of the container rim having a set of closely spaced rim ridges, the set of ridges positioned on the skirt at a location for engaging with the set of rim ridges when the lid is positioned on the container rim.

11. A removable lid for a container, the container of the type having a defined storage chamber and an opening for providing access to the chamber, the opening having an upstanding, peripheral container rim, the container rim having an outwardly directed bead portion, the lid comprising:

a body portion dimensioned to cover at least a portion of the container opening, the body portion having a main section and a pouring section, the pouring section hinged to the main section, a skirt projecting from the body portion and formed to engage at least a portion of the container rim for supporting the body portion in a covering relationship with container opening, the main section and the pouring section both having a corresponding skirt section, a set of closely spaced ridges formed at a defined location on an interior surface of the skirt, the set of ridges aligned transverse to the side edge of the container rim, the ridges engaging the container rim when the body portion is positioned thereon in a covering relationship with the opening, the set of ridges formed to frictionally engage the container rim to a greater extent than the remaining portions of the interior of the skirt, wherein the set of ridges is formed on the main skirt section adjacent the hinged attachment of the pouring section, and at least one retention tab projecting from the inside surface of the skirt for engaging the underside of the bead portion on the container rim, the retention tab spaced from the position of the set of ridges on the skirt, wherein a second closely spaced set of ridges is formed on the interior of the skirt at a defined location that is spaced from the location of the first mentioned set of ridges.

12. The removable lid of claim 11 wherein the second set of ridges is formed on the main skirt section adjacent the hinged attachment of the pouring section.

13. The removable lid of claim 12 further comprising a second retention tab projecting from the inside surface of the skirt for engaging the underside of the bead portion on the container rim, the second retention tab being spaced from the first mentioned retention tab.

14. The removable lid of claim 13 wherein the second retention tab is aligned with the second set of ridges.

15. The removable lid of claim 13 wherein the second retention tab is formed on the main skirt section in a spaced relationship with the first and second set of ridges.

16. The removable lid of claim 13 wherein the second retention tab is formed on the pouring skirt section.

17. The removable lid of claim 13 wherein the second retention tab is formed on the main skirt section.

18. The removable lid of claim 17 wherein the main skirt portion is larger than the pouring skirt portion.

19. A container and lid combination comprising:

a hollow container body having an opening thereon defined by a projecting rim, the rim forming a chime, the rim having a formed bead projecting at least partially transverse to the direction of the rim projection, an outwardly directed portion of the bead having a defined set of closely spaced grooves formed therein, the defined set of grooves formed substantially transverse to the outward projecting portion of the bead, and a lid having a body for covering at least a portion of the opening, a peripheral skirt depending from the body, the skirt engaging the rim of the container and securing the lid on the opening, over the chime, at least one set of ridges formed on the skirt and positioned to engage the container rim substantially transverse to the outward projection of the bead, the at least one set of ridges positioned on the skirt for engaging within the defined set of grooves on the bead, the engagement frictionally securing the lid on the opening of the container.

20. A container and lid combination comprising:

a hollow container body having an opening thereon defined by a projecting rim, the rim forming a chime, a formed bead projecting at least partially transverse to the chime of the projecting container rim, the bead portion of the container rim includes a set of closely spaced rim ridges, and a lid having a body for covering at least a portion of the container opening, a peripheral skirt depending from the body portion, the skirt engaging the rim of the container and securing the, lid on the opening, over the chime, at least one set of ridges formed on the skirt and positioned substantially transverse to the bead, the ridges frictionally engaging the bead for securing the lid on the opening of the container, the set of ridges positioned on the skirt for engaging with the set of rim ridges when the lid is positioned on the container rim.

21. The container and lid combination of claim 20 wherein the lid further comprises at least one retention tab projecting from the inside surface of the skirt for engaging the underside of the outward projecting portion of the bead on the container rim.

22. The container and lid combination of claim 21 wherein the retention tab is spaced from the position of the set of ridges on the skirt.

23. The container and lid combination of claim 22 wherein a second set of ridges is formed on the main skirt section adjacent the hinged attachment of the pouring section.

24. The container and lid combination of claim 21 further comprising a second retention tab projecting from the inside surface of the skirt for engaging the underside of the bead portion on the rim, the second retention tab being spaced from the first mentioned retention tab.

25. The container and lid combination of claim 21 wherein the body comprises a main section and a pouring section, the pouring section hinged to the main section, each section having a corresponding skirt section.

26. The container and lid combination of claim 25 wherein the set of ridges is formed on the main skirt section adjacent the hinged attachment of the pouring section.

27. A container and lid combination comprising:

a hollow container body having an opening thereon defined by a projecting rim, the rim forming a chime, the rim having a formed bead projecting at least partially transverse to the direction of the rim projection, and a lid having a body for covering at least a portion of the container opening, a peripheral skirt depending from the body portion, the skirt engaging the rim of the container and securing the lid on the opening, over the chime, at least one set of ridges formed on the skirt and positioned substantially transverse to the bead, the ridges frictionally engaging the bead for securing the lid on the opening of the container, a first retention tab projecting from the inside surface of the skirt for engaging the underside of the projecting bead on the container rim;

a second retention tab projecting from the inside surface of the skirt for engaging the underside of the bead portion on the container rim, the second retention tab being spaced from the first mentioned retention tab, the second retention tab aligned with a second set of ridges.

28. The container and lid combination of claim 27 wherein the body portion comprises a main section and a pouring section, the pouring section hinged to the main section, each section having a corresponding skirt section.

29. The container and lid combination of claim 28 wherein the second retention tab is formed on the main skirt section in a spaced relationship with the first and second set of ridges.

30. The container and lid combination of claim 28 wherein the second retention tab is formed on the pouring skirt section.

31. The container and lid combination of claim 28 wherein the second retention tab is formed on the main skirt section.

32. The container and lid combination of claim 31 wherein the main skirt portion is larger than the pouring skirt portion.

33. A container and lid combination comprising:

a hollow container body having an opening thereon defined by a projecting rim, the rim forming a chime, the rim having a formed bead projecting at least partially transverse to the direction of the rim projection, a lid having a body for covering at least a portion of the container opening, a peripheral skirt depending from the body portion, the skirt engaging the rim of the container and securing the lid on the opening, over the chime, a set of ridges formed on the skirt and positioned substantially transverse to the bead, the ridges frictionally engaging the bead for securing the lid on the opening of the container, and a second closely spaced set of ridges formed on the interior of the skirt at a defined location that is spaced from the location of the first set of ridges.

* * * * *